US005507996A

United States Patent [19]

Brouard

[11] Patent Number: 5,507,996

[45] Date of Patent: Apr. 16, 1996

[54] METHOD AND APPARATUS FOR MANUFACTURING BUILDING BLOCKS FROM A HYDRAULIC BINDER SUCH AS PLASTER, AN INERT FILLER SUCH AS SAND, AND WATER

[75] Inventor: Jean Brouard, Saint-Lye-La-Foret, France

[73] Assignee: TECFIM, Epinay-Sur-Orge, France

[21] Appl. No.: 146,154

[22] PCT Filed: May 14, 1992

[86] PCT No.: PCT/FR92/00424

§ 371 Date: Nov. 12, 1993

§ 102(e) Date: Nov. 12, 1993

[87] PCT Pub. No.: WO92/20502

PCT Pub. Date: Nov. 26, 1992

[30] Foreign Application Priority Data

May 15, 1991 [FR] France ..... 91 05870

[51] Int. Cl.[6] ..... B28B 3/00

[52] U.S. Cl. ..... 264/333; 264/40.5

[58] Field of Search ..... 264/333, 40.4, 264/40.3, 40.5; 425/149, 141, 411, 419, 422

[56] References Cited

U.S. PATENT DOCUMENTS

| | | | |
|---|---|---|---|
| 1,911,011 | 5/1933 | Brotz . | |
| 2,026,337 | 12/1935 | Yingling . | |
| 2,280,635 | 4/1942 | Ishman . | |
| 3,809,566 | 5/1974 | Revord . | |
| 3,833,331 | 9/1974 | Springs | 264/333 X |
| 4,164,537 | 8/1979 | Drostholm et al. | 264/333 |
| 4,253,636 | 3/1981 | Grady et al. . | |
| 4,639,345 | 1/1987 | Olsen | 264/333 X |
| 5,000,793 | 3/1991 | Brouard . | |
| 5,002,711 | 3/1991 | Iwama et al. | 264/333 X |
| 5,116,555 | 5/1992 | Thole et al. . | |
| 5,139,721 | 8/1992 | Castonguay et al. | 264/333 X |
| 5,188,848 | 2/1993 | Taddei | 264/40.4 X |
| 5,248,466 | 9/1993 | Russell, III | 264/333 X |

FOREIGN PATENT DOCUMENTS

| | | |
|---|---|---|
| 2013151 | 9/1990 | Canada . |
| 390302 | 10/1990 | European Pat. Off. . |
| 355180 | 10/1905 | France . |
| 1245619 | 10/1960 | France . |
| 1511233 | 1/1968 | France . |
| 219428 | 3/1985 | Germany . |
| 3939280 | 2/1991 | Germany . |
| 146916 | 10/1921 | United Kingdom . |
| 188905 | 11/1922 | United Kingdom . |
| 884896 | 12/1961 | United Kingdom . |
| 1201921 | 8/1970 | United Kingdom . |
| WO82/00297 | 2/1982 | WIPO . |
| 88/03916 | 6/1988 | WIPO . |

*Primary Examiner*—Karen Aftergut
*Attorney, Agent, or Firm*—Bell, Seltzer, Park & Gibson

[57] ABSTRACT

A method and apparatus for manufacturing a building block by molding under pressure a mixture of a hydraulic binder such as plaster, an inert filler such as sand, and water, by passing a mold (50) through various stations, including a station (A) for filling the mold with a measured quantity of the mixture (56), a station (B) for installing a mold top plate (38), a station (C) for compressing the mixture in the mold, a station (D) for keeping the top and bottom plates (38, 40) in place in the mold, a station (E) for withdrawing the top plate (38), and an unmolding station (F).

5 Claims, 3 Drawing Sheets

30
38
40
50
52
54
56
58
60
62
64
66
68
70
72
74
76
78
80
82
84

METHOD AND APPARATUS FOR MANUFACTURING BUILDING BLOCKS FROM A HYDRAULIC BINDER SUCH AS PLASTER, AN INERT FILLER SUCH AS SAND, AND WATER

The invention relates to a method and to apparatus for manufacturing building blocks by molding under high pressure a mixture of a hydraulic binder such as plaster, an inert filler such as sand, and water.

Such building blocks and the method of manufacturing them have already been described in international patent application WO 88/03916 of the same inventor.

That method consists essentially in molding under high pressure the mixture of plaster, sand, and water, for a sufficient length of time, of the order of 2 minutes to 3 minutes, corresponding to the hydration under pressure of plaster which gives rise to an opposed expansion of the plaster inside the mold, and also to densification and reorientation of its crystal lattice.

Building blocks obtained in this way have remarkable characteristics: compression strength considerably greater than 100 kg/cm$^2$, hardness equivalent to that of soft stone, good resistance to damp and to frost, and dimensional accuracy of the order of one-tenth of a millimeter, thereby enabling them to be placed directly one on another without interposing traditional jointing between the blocks.

In addition, the blocks are ready for use in building on being unmolded, without drying.

In building, that provides considerable savings both in the time and in the skills required of the workers, such that the costs associated with building proper are divided by a factor of not less than 2 or 3.

An object of the present invention is to provide considerable improvement to that method, and to the means for implementing the method, thereby enabling the characteristics of the above-specified building blocks to be further improved, enabling their quality to be made more uniform, and enabling their cost price to be reduced.

Another object of the invention is to provide means enabling such blocks to be manufactured in large quantities and at a high rate.

To this end, the present invention provides a method of manufacturing building blocks from a mixture of a hydraulic binder such as plaster, an inert filler such as sand, and water, the mixture being molded under pressure during a period of time that is sufficient for obtaining hydration under pressure of the hydraulic binder and densification of its crystal lattice, the method being characterized in that it consists in placing a measured quantity of the mixture in a mold having undeformable side walls and top and bottom horizontal plates that are movable in vertical translation inside the mold with small clearance relative to the side walls, then in slowly displacing at least one of the plates in the mold over determined strokes successively to settle the mixture inside the mold and then to impart a predefined height to the block that is to be obtained by progressively exerting high pressure on the mixture in the mold, in keeping said plates in place during the above-mentioned period of time during which opposed expansion of the hydraulic binder takes place in the mold, and then in moving one of the plates away for the purpose of unmolding the block by displacing the other plate towards the inside of the mold.

The slow compression of the mixture placed in the mold has the following effects in succession: settling the mixture in the mold, with its bulk factor being reduced; expelling the air contained in the mixture and accelerating wetting of the mixture by putting the water under pressure; expelling from the mold any water that may be in excess relative to the exact quantity of water required for hydrating the plaster; and accurately defining the height (i.e. the dimension between the horizontal plates of the mold) of the building block that is to be obtained. By keeping the mold plates in place in the positions they occupy at the end of the compression stage, it is possible to conserve this height during the following stage which is a stage of hydration under pressure and of opposed expansion of the plaster in the mold.

The building blocks produced in this way are of well-defined dimensions and they have compression strength that is not less than a predetermined value.

According to another characteristic of the invention, the method also consists in detecting the increase in pressure in the mold that results from the opposed expansion of the hydraulic binder, for the purpose of defining the end of the period of opposed expansion in the mold, and in unmolding the building block once said pressure has reached a predetermined value.

Preferably, said predetermined value of pressure in the mold corresponds to no more than about 70% to 90% of complete hydration of the hydraulic binder in the mold, so as to reduce the force that needs to be provided for unmolding the building blocks and so as to reduce mold wear.

The invention also provides apparatus for implementing this method, the apparatus being characterized in that it comprises:

- a mold having undeformable vertical walls and top and bottom horizontal plates which are movable in translation inside the mold with a small amount of clearance relative to the vertical walls;
- means for positioning the bottom plate inside the mold;
- means for filling the mold with a measured quantity of the above-mentioned mixture;
- means for installing the top plate in the mold;
- at least one hydraulic press controlled to displace at least one of the plates slowly inside the mold over determined strokes successively to settle the mixture inside the mold and then to compress it under high pressure until reaching the height desired for the block to be obtained;
- means for keeping the plates in place inside the mold during the opposed expansion of the hydraulic binder in the mold;
- means for withdrawing at least one of the plates from the mold; and
- hydraulically actuated unmolding means for extracting the block from the mold.

Depending on the embodiment of this apparatus, the means for holding the plates in place in the mold may be constituted either by the above-mentioned hydraulic actuation(s) of the press, or else by mechanical and/or hydraulic means that are independent of said press.

Furthermore, the apparatus may also comprise means for detecting the increase in the pressure of the mixture in the mold resulting from the opposed expansion of the hydraulic binder.

Preferably, at least the top plate of the mold includes an oblique rim over at least a fraction of the periphery of its face that comes into contact with the mixture in the mold, for the purpose of forming (continuous or discontinuous) a chamfer over at least a fraction of the top peripheral edge of the building block.

The presence of the chamfer avoids any risk of the top peripheral edge of the building block cracking or bursting when the mold plates are released at the end of the opposed expansion stage, prior to unmolding.

Furthermore, by providing an identical chamfer on the bottom peripheral edge of the building block, the appearance of a structure built by placing said blocks one on another is improved.

According to another characteristic of the invention, said press comprises top and bottom plates between which the mold is placed, which plates are interconnected by a mechanical transmission suitable for positively defining a minimum distance between the plates of the press that corresponds to the height desired for the building block, and for ensuring that the plates are parallel.

This avoids the use of mechanical abutments against which the plates of the press would otherwise come to bear, and the tension or compression forces to which elements of said mechanical transmission are subjected during the opposed expansion stage of the hydraulic binder in the mold can be measured to define the end of said opposed expansion stage.

In general, the invention makes it possible to automate the method of manufacturing building blocks in a manner that is reliable and safe, to improve their quality and make it more uniform, and to increase very considerably the rate at which they are manufactured.

The invention will be better understood and other characteristics, details, and advantages thereof will appear more clearly on reading the following description given by way of example and made with reference to the accompanying drawings, in which:

FIGS. 1, 2, and 3 are diagrammatic views of a building block of the invention, respectively as seen from above, in vertical section, and as seen from below;

Figure 1:
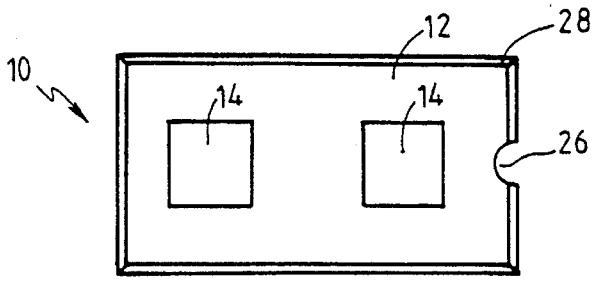
FIG.1 PRIOR ART
Figure 2:
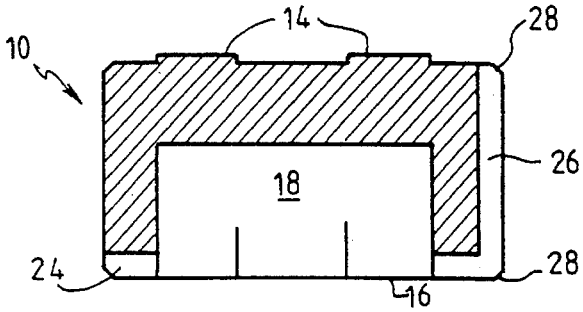
FIG. 2 PRIOR ART
Figure 3:
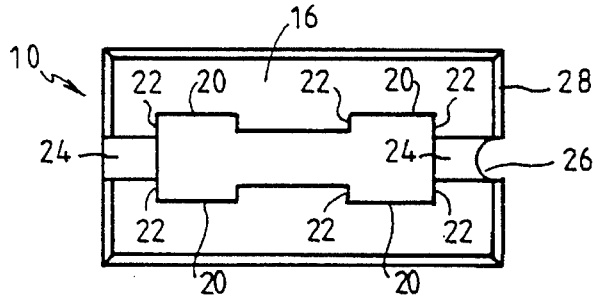
FIG.3 PRIOR ART

The building block shown in FIGS. 1 to 3 is substantially identical to that described in international application WO 88/03916 and is in the form of a rectangular parallelepiped having dimensions that may be 15 cm by 15 cm by 30 cm, for example. A block of the invention having such dimensions may weigh somewhat more than 10 kilograms, and is easily manipulated by hand. Naturally, the invention also makes it possible to manufacture blocks of different shapes and sizes.

The top face 12 of the block includes low projections 14 that are square or circular in shape, for example.

The bottom face 16 of the block includes a cavity 18 of relatively large volume (e.g. about 30% of its total volume), extending over a certain height inside the block 10 and opening out into the bottom face 16 of the block in a manner that is delimited by longitudinal edges 20 and transverse edges 22 which define housings for receiving the projections 14 on the top face of another block.

Furthermore, the bottom face 16 of the block includes a longitudinal groove or channel 24 extending along its entire length, in communication with the cavity 18, and opening out at one of its longitudinal ends into a vertical groove 26 formed up the entire height of the block, in one of its vertical end faces.

As explained in the above-mentioned international application, the blocks 10 are designed to be placed one on another and one beside another, with all of the blocks being oriented in the same direction so as to form a wall having horizontal rows of blocks in which the blocks in any one row are offset relative to an adjacent row by half the length of a block. Relatively liquid plaster is poured on two occasions into the vertical grooves 26, firstly to fill the cavities 18 of the blocks partially where they overlie the projections 14 on the top faces of the lower blocks, and secondly to fill the vertical grooves 26.

As can be seen in FIGS. 1 to 3, a chamfer 28 is formed on at least a fraction of the peripheral edge both of the top face and of the bottom face of the building block. Identical chamfers may also be formed on the vertical edges of the block.

Figure 4:
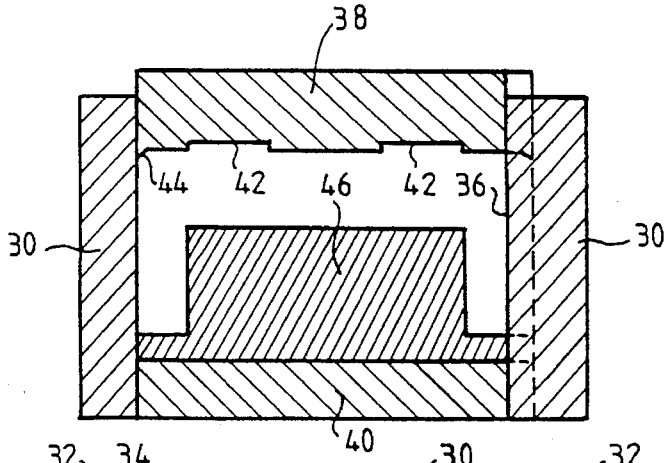
FIG. 4 is a diagrammatic vertical section view through a mold for manufacturing the block.
Figure 5:
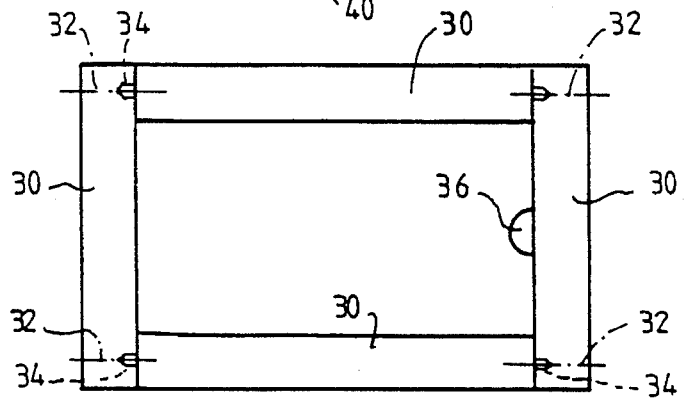
FIG. 5 is a diagrammatic plan view of the mold with its top plate removed.

FIGS. 4 and 5 are diagrams showing a mold used for manufacturing the block shown in FIGS. 1 to 3.

The mold comprises four vertical steel walls 30 which are rigidly assembled together, preferably by means of bolts 32, and which are positioned relative to one another by means of centering studs 34 for accurately defining the length and the width of the mold cavity to dimensional tolerance of the order of a few hundredths of a millimeter. The inside faces of the vertical walls 30 are rectified so as to be accurately smooth and plane. One of the vertical walls 30 forming one of the small vertical end faces of the mold includes a semicylindrical vertical projection 36 up its entire height for the purpose of forming the vertical groove 26 in the resulting building block.

The vertical walls 30 of the mold are taller than the block that is to be obtained, so as to make it possible for the top plate 38 and for the bottom plate 40 of the mold to be received between them. When the block to be made has a height of 15 cm, then the vertical walls 30 of the mold will have a height lying in the range about 25 cm to about 30 cm.

The plates of the mold are rectangular steel plates of dimensions suitable to enable them to be moved in vertical translation inside the mold with a small amount of clearance equal to a few tenths of a millimeter relative to the vertical walls. Furthermore, the inside faces of the vertical walls 30 form a small relief angle of about 0.5° so as to facilitate the unmolding of a building block.

The bottom face of the top plate 38 of the mold includes two small cavities 42 of shapes corresponding to the shapes of the projections 14 on the top face of the building block to be obtained, and a sloping peripheral rim 44 for forming the chamfer 28 on the block to be obtained. This sloping rim may be provided on a fraction only of the periphery of the bottom face of the plate 38. One of the small vertical faces of the plate 38 includes a semicylindrical groove corresponding to the vertical projection 36.

The top face of the bottom plate 40 carries a core 46 for forming the cavity 18 and the longitudinal channel 24 in the bottom face of the block to be obtained. In addition, a small vertical face of said plate 40 and of the core 46 includes a semicylindrical vertical groove designed to receive the vertical projection 36 of the corresponding side wall 30 of the mold. The top edge of the plate 40 also includes an oblique peripheral rim for forming the above-mentioned chamfer 28 of the building block. As before, the oblique rim may be provided solely on a fraction of the periphery of the plate 40.

In a variant embodiment of the mold, at least one of the large vertical walls 30 of the mold is fixed in an easily removable manner to the other walls by any appropriate means, e.g. including hinges and/or locking levers. The removal of said large wall 30 of the mold can facilitate upholding the building block. In addition, the wall 30 may be designed to receive a plate on its inside face of any suitable material for the purpose of forming facade decoration on the building block.

Figures 6A, 6B, 6C, 6D, 6E, 6F:
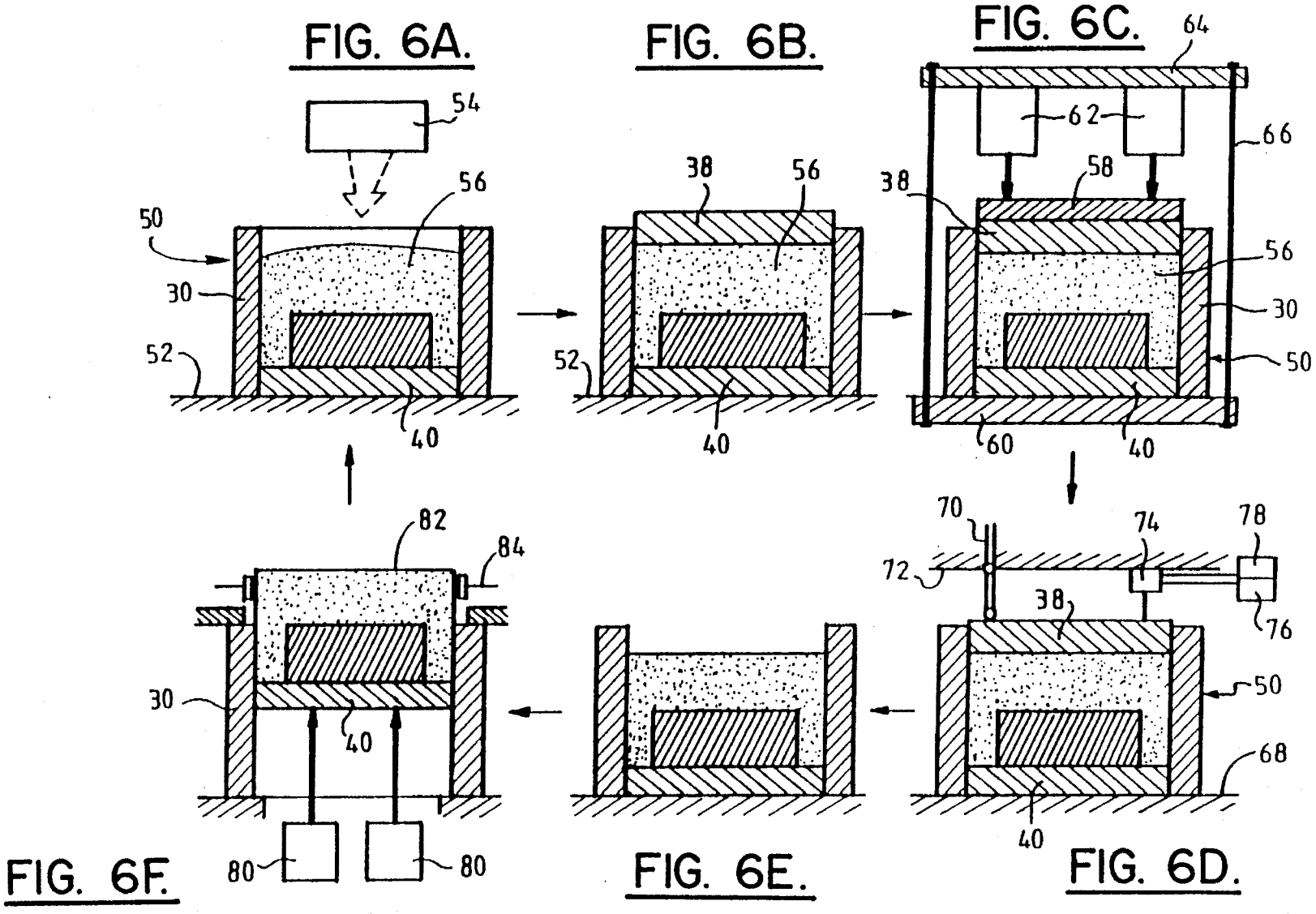
FIGS. 6A–6F is a diagram showing the various manufacturing stations used in the manufacture of the block, in one embodiment of the invention.

The various stations of apparatus of the invention for manufacturing a building block are shown diagrammatically in FIG. 6.

In this figure, the outline of the mold 50 has been simplified, but it will naturally be understood that the mold may be identical to that shown diagrammatically in FIGS. 4 and 5.

A first station of the apparatus of the invention given overall reference A is a station for filling the mold 50. In this station, the mold 50 stands on a support surface 52 which may form a part of transfer means for transferring molds between the various stations of the manufacturing apparatus. The bottom plate 40 of the mold is likewise carried by said support surface 52 so as to occupy a defined position inside the mold. Means 54 enable a measured quantity of a mixture 56 of a hydraulic binder such as plaster, an inert filler such as sand, and water, to be poured into the mold. The means 54 for delivering said mixture are advantageously designed also to moisten a dry mixture of plaster and sand with a quantity of water that is substantially equal to or slightly greater than the quantity of water required for optimum compactness of the mixture (said quantity of water being greater than the quantity required for hydrating the plaster).

To manufacture a building block as shown in FIGS. 1 to 3, and having dimensions of 15 cm by 15 cm by 30 cm, a mixture is used that comprises about 7 kg of sand, 4 kg of plaster, and 1.3 to 1.5 liters of water, depending on sand and plaster grain size. The mixture is poured into the mold in a few seconds.

The mold is then transferred to the following station given overall reference B where the top plate 38 of the mold is placed in the mold and rests on the mixture 56 of plaster, sand, and water.

One or both of the stations A and B may optionally include a vibrating table for initiating settling of the mixture 56 in the mold, for evacuating trapped air, and for improving wetting.

The following station given overall reference C essentially comprises a hydraulic press having two moving horizontal plates 58 and 60 with the mold 50 being placed between them. One or more hydraulic actuators 62 serve to displace the plates of the press, e.g. synchronously, in opposite directions so as to move them towards each other so as to move them apart. By way of example, the piston rods of actuators 62 bear against the top plate 58 of the press while the cylinders of said actuators are carried by a horizontal plate 64 that is movable in vertical translation and that is connected via tie bars 66 to the bottom plate 60 of the press.

The tie bars 66 make it possible to obtain and to maintain the desired distance between the plates of the molds, and they are subject to tension forces that may be measured for monitoring proper operation of the method.

The top plate 58 of the press bears against the top plate 38 of the mold, while the vertical walls 30 and the bottom wall 40 of the mold bear against the bottom plate 60 of the press.

The mixture 56 is slowly compressed in the mold, and preferably in two stages:

- a first stage during which the mixture 56 is merely caused to settle in the mold by the top plate 38 moving down inside the mold along a stroke of several centimeters (4 cm to 10 cm, for example), with the duration of this stroke being several seconds (e.g. about 5 s to about 10 s); and
- a second stage during which the top plate 38 is thrust into the mold over a stroke of several centimeters until the distance between the plates 38 and 40 in the mold is equal to the height desired for the building block. The duration of this second stage is several seconds, and the pressure applied to the mixture 56 inside the mold reaches values lying in the range about 50 kg/cm$^2$ to about 100 kg/cm$^2$, depending on circumstances.

These two compression stages may be implemented either by displacing one of the two plates 38 and 40 inside the mold, or by displacing both of the plates 38 and 40 towards each other.

While the mixture 56 is being compressed in the mold, the air contained in the mixture is expelled through the clearance between the vertical walls and the plates of the mold, with the water spreading uniformly throughout the mixture of plaster and sand because of the pressure exerted, and any excess water is expelled through the clearance between the vertical walls and the plates of the mold. The distance between the plates 38 and 40 of the mold, corresponding to the desired height of the block to be obtained, is preferably defined in positive manner by a mechanical transmission that interconnects the plates 58 and 60 of the press and that ensures that they remain parallel.

When the mold plates 38 and 40 have been brought to the desired distance corresponding to the height of the block to be obtained, they are locked in place. The pressure inside the mold then drops considerably over a short period of time after which it increases progressively as the plaster expands, because it is being hydrated.

Consequently, when the plates 38 and 40 of the mold have been brought to the desired distance apart from each other by the hydraulic actuators 62 of the press, the actuators are driven so as to move the plates 58 and 60 apart and thus allow the mold 50 to be transferred to the following station given overall reference D in which the plates 38 and 40 of the mold are held in a position that corresponds to the desired height for the block to be obtained. To do this, the station D may include, for example, means 68 for supporting the mold and the bottom plate 40, and means for bearing against the top plate 38, said means may be mechanical in type, e.g. levers 70 mounted to rotate relative to a support 72, and/or hydraulic in type, e.g. actuators 74 carried by the support 72.

The mold 50 is held in the station D for a length of time sufficient for the plaster to be hydrated to about 70%–90% inside the mold 50. This length of time may lie in the range about 1.5 minutes to about 5 minutes, depending on temperature, the type and quantity of plaster used, and the degree of plaster hydration that it is desired to obtain under pressure. The increase in pressure inside the mold 50 that results from the opposed expansion of the plaster may be very large, and may reach values of the order of 100 kg/cm$^2$.

The thrust means 70, 74 therefore need to be strong enough to oppose the pressure exerted on the top plate 38 of the mold.

The pressure inside the mold is preferably detected by suitable means, so that the thrust means 70, 74 release the top plate 38 of the mold as soon as said pressure has reached a predetermined value. For example, this may be done by measuring the pressure inside the hydraulic actuators 74 and by connecting said actuators to exhaust as soon as the pressure has reached a predetermined value, or else the force exerted on the levers 70 may be measured and the levers can be caused to rotate so as to release the plate 38 when said force reaches a determined value. It is also possible to measure the tension in the rods interconnecting the supports 68 and 72 and to cause the top plate 38 to be released as soon as said tension reaches a predetermined value.

It is also possible to fit each hydraulic actuator 74 with a pressure limiter so that the pressure inside the mold 50 cannot exceed a predetermined value.

By way of example, station D includes a diagrammatic representation of means 76 for measuring the pressure in an actuator 74, said means 76 being associated with means 78 for controlling the actuator.

At the end of this stage of opposed expansion of the plaster inside the mold 50, the means 70 and 74 that bear against the top plate 38 of the mold are moved apart and the mold is transferred to the following station given overall reference E, where the top plate 38 of the mold is withdrawn.

The mold is then transferred to the following station given overall reference F and which constitutes an unmolding station.

In this station, the vertical walls 30 of the mold are held stationary between abutments, and one or more hydraulic actuators 80 apply considerable force to the bottom plate 40 so as to push it upwards, thereby enabling the block 82 to be extracted by grasping and transfer means 84, the block 82 being ready for handling and for use immediately on leaving the mold. At the beginning of unmolding, the force provided by the actuator(s) 80 may be very large (e.g. of the order of 100 kg/cm$^2$) over a short stroke, after which the vertical relief of the faces 30 facilitates upwards displacement of the bottom plate 40.

Thereafter the position of the bottom plate 40 inside the mold must be moved back down again (e.g. by means of the actuators 80), after which the mold is transferred to station A ready for being refilled with a mixture of plaster, sand, and water.

The station that is occupied for the greatest length of time by the molds is the station D in which the opposed expansion of the plaster takes place over a period of time lying in the range about 1.5 minutes to about 5 minutes. The apparatus of the invention may therefore include a plurality of such stations organized to be displaceable along a path of determined length between the station C and the station E, e.g. by means of a carousel that has about ten stations D, and that rotates stepwise between station C and station E.

The apparatus as a whole may also be in the form of a carousel that rotates between stations A, C, and F, and that includes a plurality of stations D, together with means for placing and removing the top covers 38 of the molds.

Manufacturing throughput is then limited only by the length of time required for operations in station C, which is of the order of about 15 seconds, so throughput can reach about 200 blocks per hour.

This throughput can be greatly increased, by performing the first stage of compression of the mixture in the mold while in station B, and by performing the second stage in station C.

If necessary, to further increase throughput, it is possible to use molds having multiple cavities, thereby enabling manufacturing throughput to be multiplied by the number of cavities in each mold.

In a simplified embodiment, the apparatus of the invention comprises stations A, C, and F only, in which case the top plate 38 of the mold is permanently fixed to the underside of the top plate 58 of the press. Under such circumstances, the operations of settling the mixture in the mold, of compacting it, and of holding the mold plates in place during opposed expansion of the plaster are all performed in the press. Manufacturing throughput is then reduced to about 20 blocks per hour (if molds are used that have only one mold cavity each), but the machine is relatively simple and comprises only a station for filling the molds, a station for unmolding the blocks, and a hydraulic press station. Two operatives suffice for operating such a machine.

Conversely, when the apparatus of the invention is designed to achieve a high rate of production, it may be located at the outlet from an installation that produces plaster, in which case it uses hot plaster coming directly from that installation, thereby reducing the duration of the opposed expansion, thus facilitating an increase in production rate.

Figure 7:
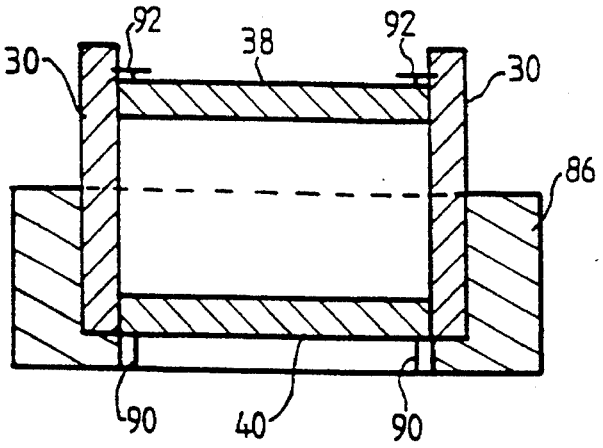
FIGS. 7 and 8 are respectively a vertical section view and a plan view of a variant embodiment of a mold.
Figure 8:
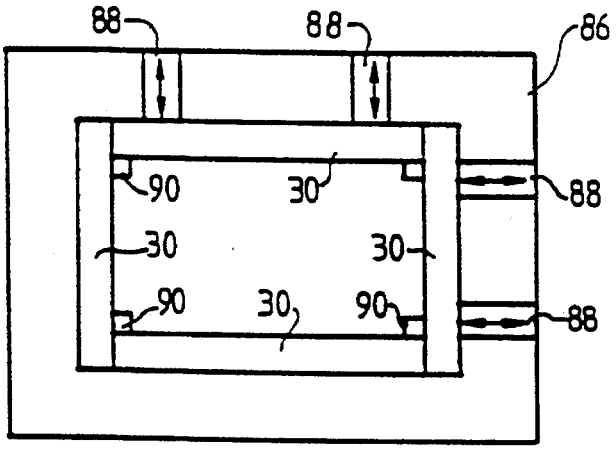

FIGS. 7 and 8 are diagrams of a variant embodiment of the mold of the invention.

In this variant, the mold constituted essentially by four vertical walls 30, the top plate 38, and the bottom plate 40, is surrounded and supported by at least one rectangularly shaped rigid frame 86 on whose sides the vertical walls 30 of the mold are fixed in removable manner. Two adjustable sides of the frame 86 include means 88 associated with the corresponding vertical walls 30 of the mold to displace them transversely inwardly and outwardly relative to the mold, as represented by double-headed arrows in FIG. 8, and over a short distance, e.g. of the order of about 1 mm to about 10 mm. These means may be mechanical, e.g. using a screw, a cam, or a lever, or else they may be hydraulic.

The base of the frame 86 may also include means 90 on which the bottom plate 40 of the mold stands.

In addition, the top plate 38 of the mold includes means 92, e.g. mechanical means, for locking the vertical walls 30 mutually in position when the top plate 38 is at a predetermined distance from the bottom plate 40, said distance being equal to the height of the block to be manufactured.

The way in which the mold of FIGS. 7 and 8 is used for manufacturing building blocks of the invention is described below with reference to FIG. 9.

Figure 9:
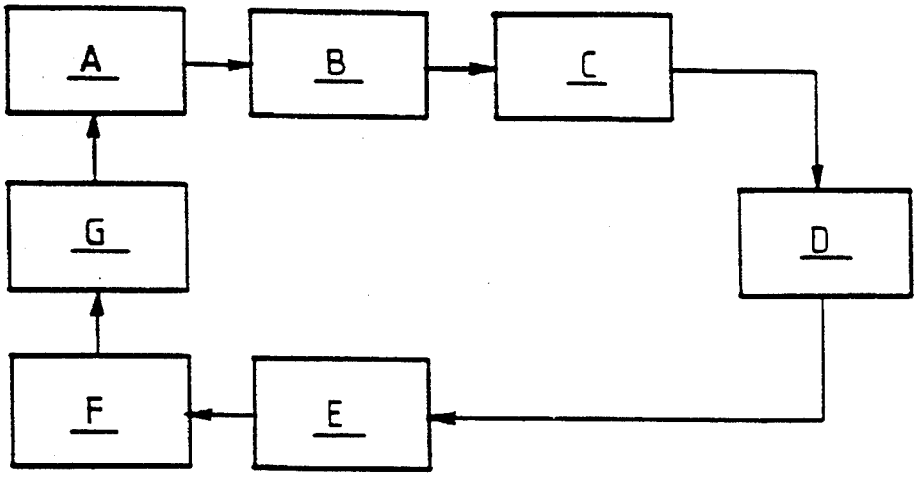
FIG. 9 is a diagram showing stations in an installation that uses the mold of FIGS. 7 and 8.

The installation shown in FIG. 9 comprises a certain number of stations A, B, C, E, F, and G, through which the mold of FIGS. 7 and 8 is passed in succession by transfer means represented diagrammatically by the arrows interconnecting the various stations of FIG. 9. Advantageously, the transfer means act on the frame 86 that surrounds and supports the mold proper.

The first station A of the FIG. 9 installation is a station for filling the mold with the mixture of plaster, sand, and water. In this station, the bottom plate 40 of the mold bears against the support means 90, and the two moving vertical walls 30 of the mold are moved towards each other so as to delimit between them, and in association with the other two vertical walls 30, a mold volume having the dimensions of the block to be manufactured. The plate 38 of the mold is removed to allow the mold to be filled with the mixture of plaster, sand, and water.

At the following station B, the top plate 38 is placed on the mold and the wet mixture placed in the mold can be settled somewhat and compressed as already described with reference to FIG. 6.

The following station C is the station during which the mixture in the mold is compressed slowly, and it comprises a press that actuates on the top plate 38 to compress the mixture in the mold down to the height dimension desired for the block to be manufactured. At the end of this compression, the means 92 are actuated to lock the top plate 38 in position relative to the vertical walls 30 of the mold, after which the mold and its frame 86 are transferred from station C to station E in which the mold is opened, with the duration of the transfer between those two stations corresponding to the duration of the stage D during which the plaster in the mold is subjected to opposed expansion. This duration may be sufficient to enable the plaster to be completely hydrated between stations C and E, thereby guaranteeing dimensional stability of the blocks after unmolding.

In station E, the means 92 are actuated to release the top plate 38 and the means 88 are likewise actuated to move the two moving walls 30 of the mold apart from each other.

The mold and its frame 86 are then transferred to station F where merely lifting the bottom plate 40 suffices to unmold the building block. Because the moving walls 30 of the mold have previously been moved apart, this unmolding operation takes place without difficulty and without the block rubbing against the inside faces of the walls 30 of the mold, therefore without significant wear of said faces.

The mold and its frame 86 are then transferred to the station G which is a station for cleaning the mold, e.g. by means of jets of compressed air or by means of jets of water under pressure, and it may also optionally be a station in which a decorative plate is placed on the inside space of one of the walls 30 of the mold.

The mold and the frame 86 are then returned to the filling station A where the means 88 can be actuated again to replace the moving walls 30 in the molding position prior to filling the mold with the mixture of plaster, sand, and water.

The mold of FIGS. 7 and 8 has very considerable advantages insofar as it enables any unmolding problems to be avoided and it enables total hydration of the plaster to be performed under pressure inside the mold while guaranteeing great dimensional accuracy, of the order of one-tenth of a millimeter, for the building block manufactured in this way.

The frame 86 that surrounds the mold is of robust construction so as to be rigid and undeformable. The frames 86 fitted to respective molds can be juxtaposed, e.g. in pairs or in fours, so as to be transferred together from one station to another in the installation of FIG. 9, which installation is then fitted with a multiple press so as to double or quadruple manufacturing throughput.

The method and the apparatus of the invention are applicable to manufacturing building blocks and elements of shapes and sizes other than those of the block shown in FIGS. 1 to 3, and in particular solid blocks, blocks having multiple cavities, flat elements, corner stones, etc. . . .

I claim:

1. A method of manufacturing building blocks from a mixture of a hydraulic binder, an inert filler and water comprising:

placing a measured quantity of the mixture in a mold having undeformable side walls and top and bottom horizontal plates that are movable in vertical translation inside the mold with small clearance relative to the side walls;

slowly compressing the mixture in the mold to form a building block by progressively displacing at least one of the plates in the mold so as to settle the mixture inside the mold, to spread uniformly the water under pressure throughout the mixture, to expel any excess water and air through the clearance between the side walls and the plates of the mold and to impart a predefined height to the building block formed from the mixture in the mold;

keeping the plates in place in the mold during a period of time which is sufficient for obtaining hydration under pressure of the hydraulic binder and densification of its crystal lattice; and unmolding the block by moving one of the plates away and displacing the other plate towards the inside of the mold.

2. A method according to claim 1, further comprising detecting a pressure increase in the mold that results from the hydration of the hydraulic binder and unmolding the building block once the pressure in the mold has reached a predetermined value.

3. A method according to claim 1, wherein a quantity of water contained in the mixture placed in the mold is greater than a quantity of water required for hydrating the hydraulic binder.

4. A method according to claim 1, wherein the step of slowly compressing said mixture comprises a first stage during which the mixture is caused to settle in the mold by the top plate moving down inside the mold along a first stroke of predetermined distance, said first stroke lasting between 5 and 10 seconds, and a second stage during which the top plate is thrust into the mold over a second stroke of predetermined distance until the distance between the plates in the mold is equal to a desired height of the building block, said second stroke lasting between 5 and 10 seconds.

5. A method according to claim 1, wherein the step of unmolding the block comprises displacing some of the side walls of the mold over a short distance in an outward direction in order to facilitate unmolding.

* * * * *